United States Patent [19]

Carn

[11] 4,253,209

[45] Mar. 3, 1981

[54] SAIL BOARDS

[76] Inventor: Patrick Carn, Route de Bénodet, 29000 Quimper, France

[21] Appl. No.: 758,087

[22] Filed: Jan. 10, 1977

[30] Foreign Application Priority Data

Jan. 9, 1976 [FR] France ..... 76 00498
Dec. 16, 1976 [FR] France ..... 76 37970

[51] Int. Cl.[3] ..... B63B 7/08; B63B 35/72; B63H 9/06

[52] U.S. Cl. ..... 9/310 E; 9/2 A; 9/2 S; 9/310 F; 114/39; 114/91

[58] Field of Search ..... 114/39, 77 R, 77 A, 114/89, 90, 91, 102; 9/2 R, 2 F, 2 C, 2 S, 2 A, 310 R, 310 B, 310 E, 310 F; 403/230, 247, 256, 261

[56] References Cited

U.S. PATENT DOCUMENTS

| | | | |
|---|---|---|---|
| 2,018,548 | 10/1935 | Currey | 9/310 F |
| 2,513,857 | 7/1950 | Friedrich | 9/310 E |
| 3,150,385 | 9/1964 | Gerber et al. | 9/2 S |
| 3,287,754 | 11/1966 | Price et al. | 9/310 E |
| 3,349,741 | 10/1967 | Herbst | 114/39 |
| 3,374,495 | 3/1968 | Joyce | 9/310 E |
| 3,409,920 | 11/1968 | Brownley | 9/310 E |
| 3,487,800 | 1/1970 | Schweitzer et al. | 114/39 |
| 3,577,576 | 5/1971 | Lobb et al. | 114/39 X |
| 3,657,753 | 4/1972 | LeBlanc, Sr. | 9/310 F |
| 3,996,868 | 12/1976 | Schagen | 114/39 |

*Primary Examiner*—Robert J. Spar
*Assistant Examiner*—Edward M. Wacyra
*Attorney, Agent, or Firm*—Weiser, Stapler & Spivak

[57] ABSTRACT

A transportable sail board has one or more inflatable bladders, and an envelope subdivided into plural demountable longitudinal sections. Rigidifying elements cooperate with bladder and envelope to form a demountable, lengthwise rigid assembly.

11 Claims, 13 Drawing Figures

Figure 1:
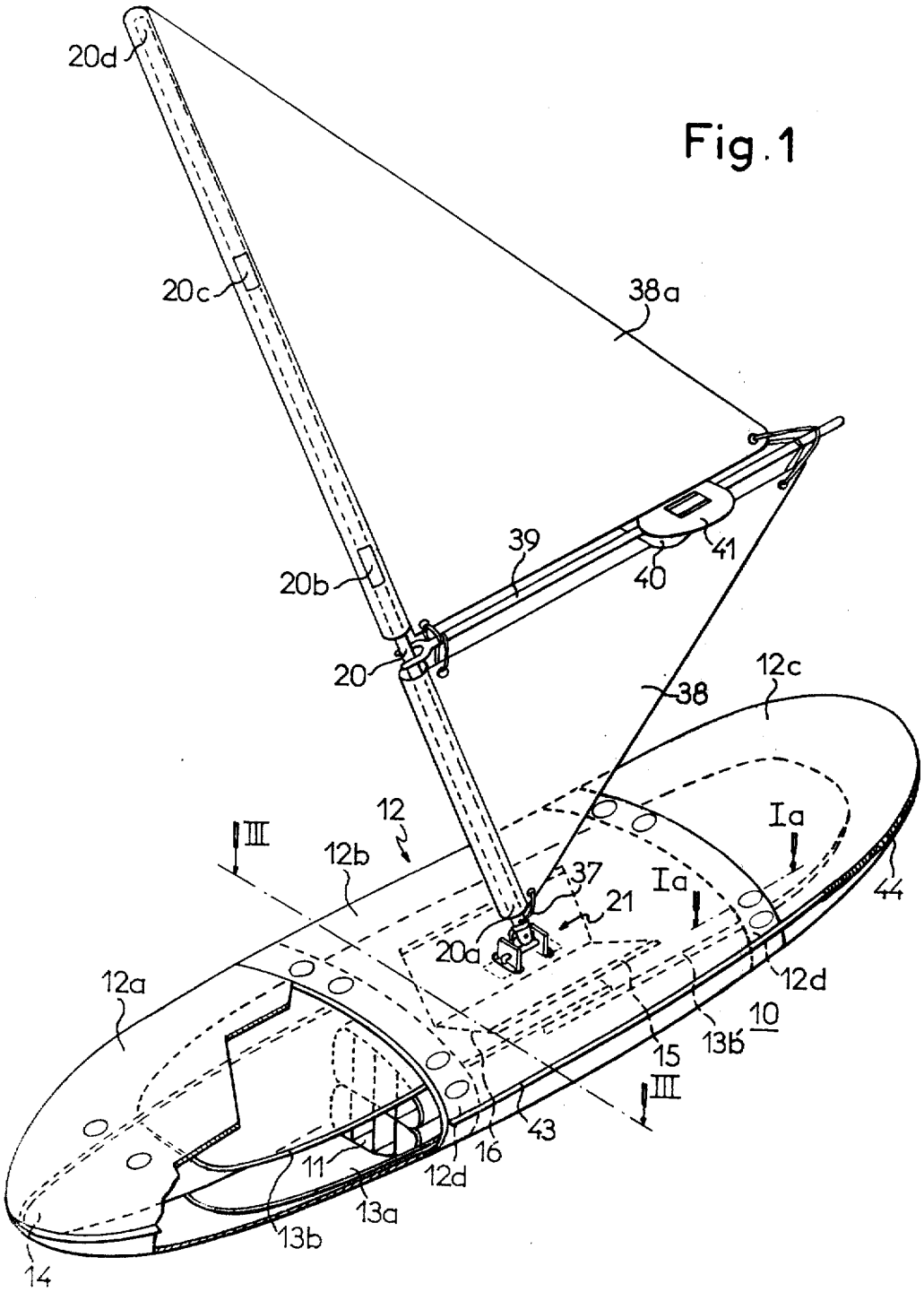

Fig.1a
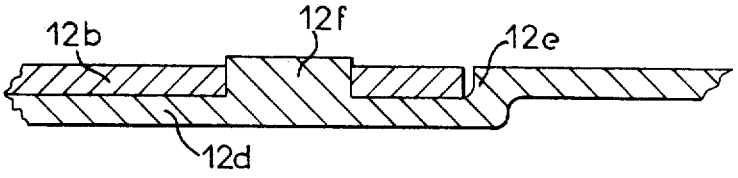
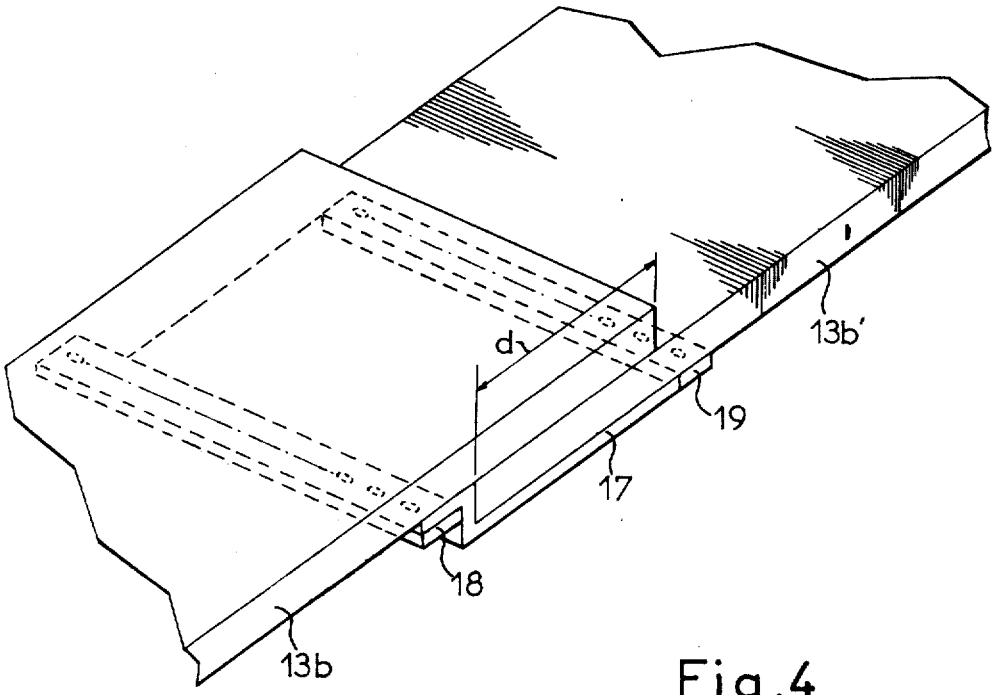
Fig.4

SAIL BOARDS

The invention relates to improvements in floating devices, particularly sail boards. Before discussing the principal embodiments of the invention, it is in order to review the difficulties encountered in the practical utilization of various types of crafts in the surf board category, whether or not equipped with rigging.

By surf board is meant a single shell boat, rigid and relatively narrow, on which the occupant balances in a standing position, and whose propulsion is obtained either by the force produced by breaking waves in case of a simple board, or by the force of the wind in case of a board equipped with rigging. Such a board has been described in U.S. Pat. No. 3,487,800 issued Jan. 6, 1970.

The rigged boards are most frequently of unitary construction, of wood in the case of old style models, and of plastic material, e.g. a rigid polyurethane foam coated with polyester layers for recent models.

These boards are relatively heavy, always bulky even when they are made of several demountable sections because these demounted sections, even when placed on top of each other, still occupy a considerable volume making it difficult to transport them in the trunk of a car. Moreover, the construction of demountable boards presents practical difficulties particularly with respect to the different types of joints needed to impart to them sufficient strength.

Accordingly, it is an object of the invention to provide a floating device of the type under discussion which is very light, of simple construction, and capable of being transported, disassembled in a small sized container.

It is another object of the invention to provide a floating device whose floatation chamber is provided by at least one inflatable pneumatic bladder.

It is another object of the invention to provide a demountable floating device requiring no tools for its assembly or disassembly.

Another object of the invention is to provide a floating device, of the type discussed, capable of being equipped with rigging including a mast orientable in all directions from a point of attachment to the hull and of consequently providing a quick attachment device of simplified construction for the foot of the mast and having high reliability particularly with regard to attack by oxidizing or abrasive agents.

These objects and others which will appear are achieved in accordance with the invention by improvements in floating devices, particularly sail boards, comprising a hull equipped with at least one keel, a mast articulated with respect to the hull, a sail for attachment to the mast, and wherein the improvements consist particularly of a hull which comprises,

- at least one inflatable bladder forming a floatation chamber,
- an envelope which is subdivided transversely to the longitudinal axis of the hull and which can be separated into several demountable, rigid or semirigid components, these components preferably numbering three, a middle component and two end components and
- rigidizing members associated with the demountable components of the envelope to form, in the assembled state of these components, a rigid envelope structure at least in the longitudinal direction of the hull, due to which one obtains particularly a demountable device of small dimensions and having in the assembled state complete longitudinal rigidity.

According to an embodiment of the invention the rigidifying members of the inflatable bladder include, in addition to the envelope components, supplemental rigidifying panels placed partly in a vertical plane and partly in a horizontal plane, each panel consisting of at least two sections fixedly attached to each other in their assembled state, preferably by means of a hinge of a strip of flexible material. In that case, the adjacent extremities of two sections of such a panel either overlap partially or abut in order to immobilize them longitudinally relative to each other.

According to a supplemental embodiment of the invention, the envelope consists of three demountable components which completely envelop the mattress and which are transversely subdivided, the middle component having uniform cross-section while the two end components are symmetrical and have progressively decreasing cross-sections, the said end components being attached to the middle component by means of an engagement lip with a shoulder having protruding connecting studs adapted to penetrate into corresponding apertures provided near the transverse edges of the said middle component.

According to another embodiment of the invention, the inflatable bladder is partially covered by envelope components particularly on the top and sides, the bottom of the bladder being in direct contact with the water. The middle cover component may be extended by two components positioned in a vertical plane, these two components having an immersed portion providing a double keel.

According to a preferred embodiment of the embodiment described above, the said transversely subdivided envelope components are maintained rigidly assembled by assembly and rigidifying elements positioned in one or more rows along the longitudinal axis of the hull, each assembly and rigidifying element being fixedly attached to an envelope component by an arrangement which permits the alignment of the assembly elements in a single row,

- the said assembly and rigidifying elements being composed, on the one hand
- by a hollow beam preferably of polygonal cross-section, and on the other hand
- by at least one locking pin corresponding to the cross-section of the beam, the said pin slidingly engaging the channel of the beam and providing the junction between two adjoining beams, particularly at the level of the transverse subdividing lines of the demountable envelope components and of the said beams, the cross-section of the assembly beam being preferably inscribable in a triangle whose base is fixed to the envelope components whereas the sides of the beam are separated at the level of the peak of the triangular section by a slot which gives access to the interior channel of the beam.

According to a characteristic of the invention, the inflatable bladder, composed of a sufficient number of tubular chambers parallel to the axis of the hull to cover the width of the envelope components, may extend beyond the contour of the envelope components in the form of an inflatable and stabilizing shock absorbing belt either united to or not united to the bladder.

Figure 2:
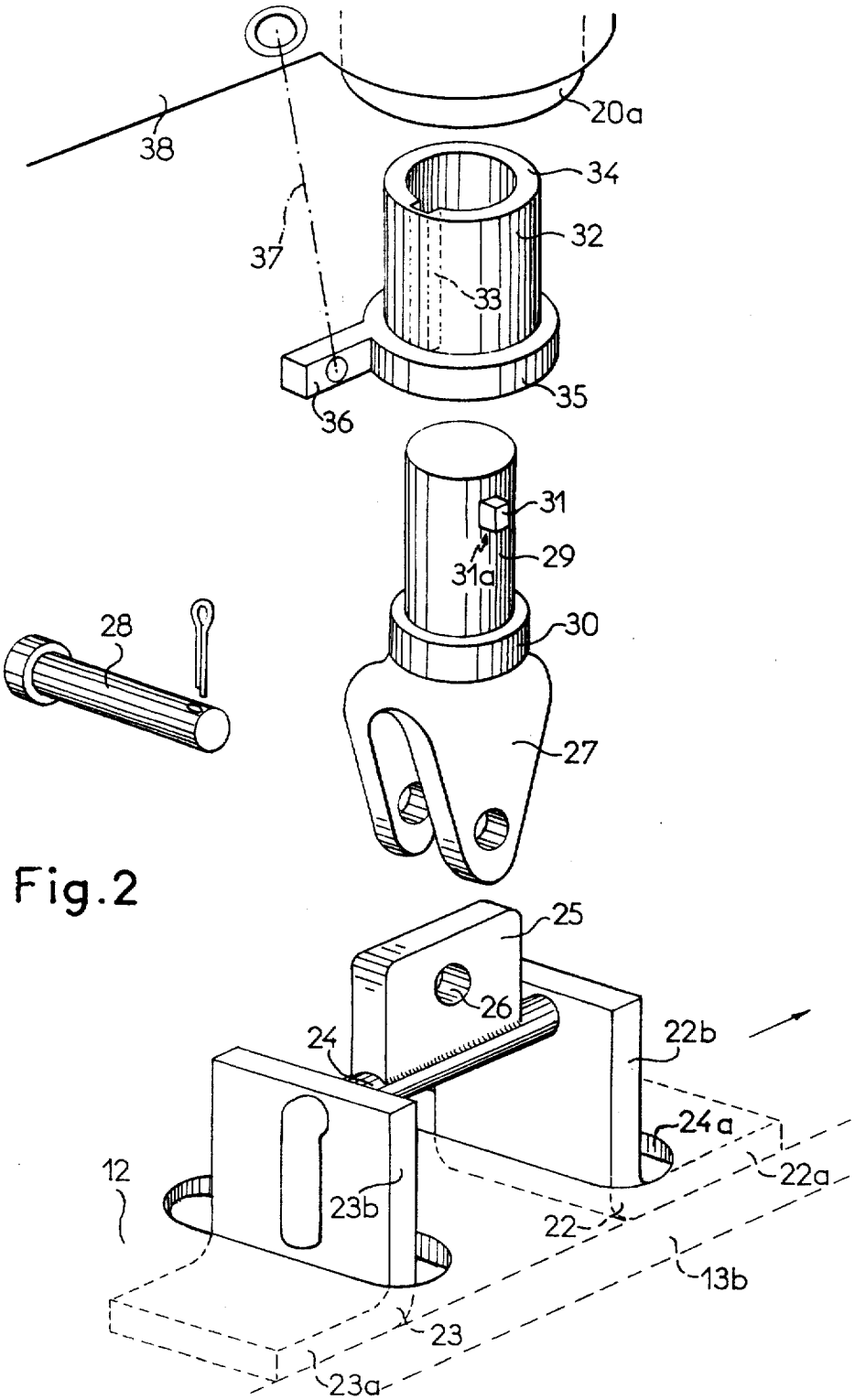
Figure 3:
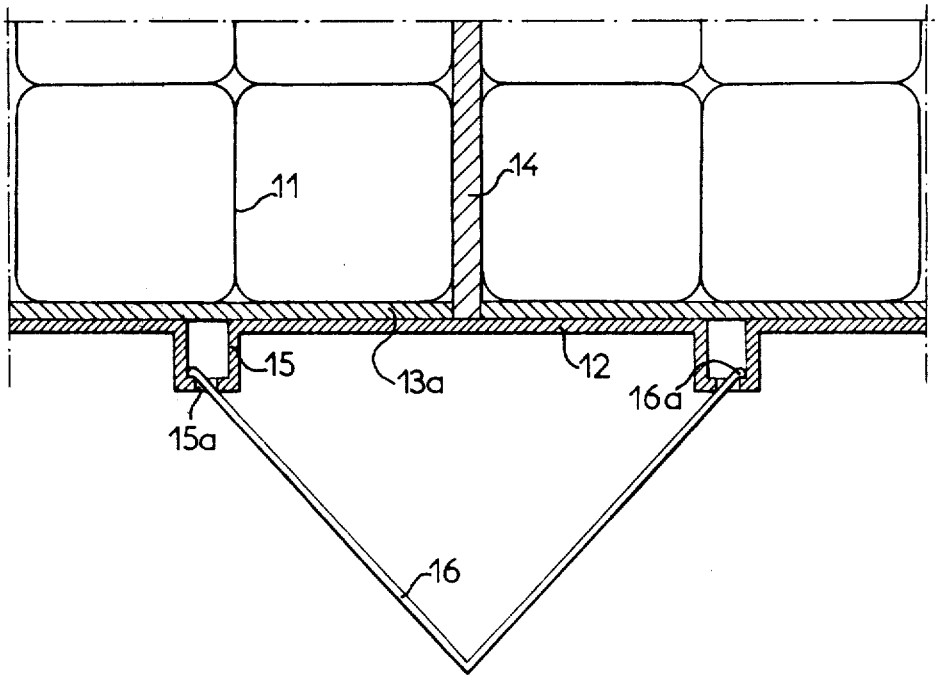
Figure 5:
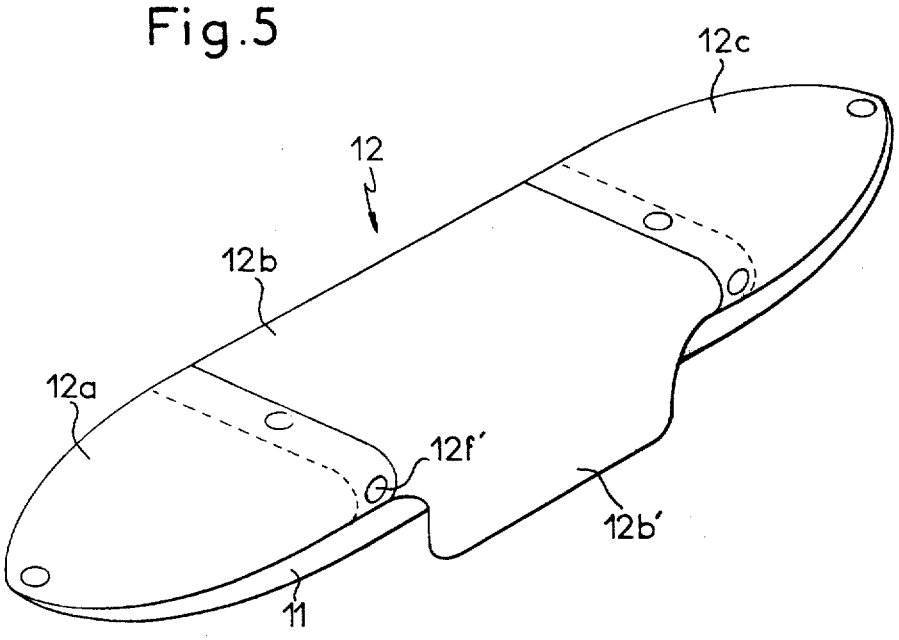
Figure 6:
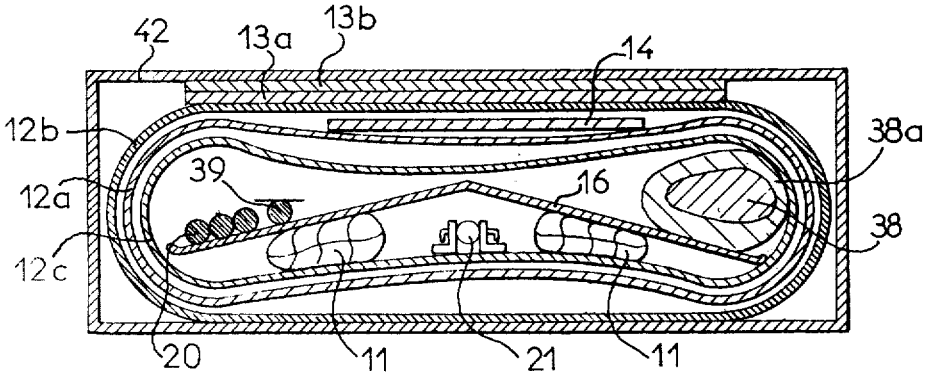
Figure 7:
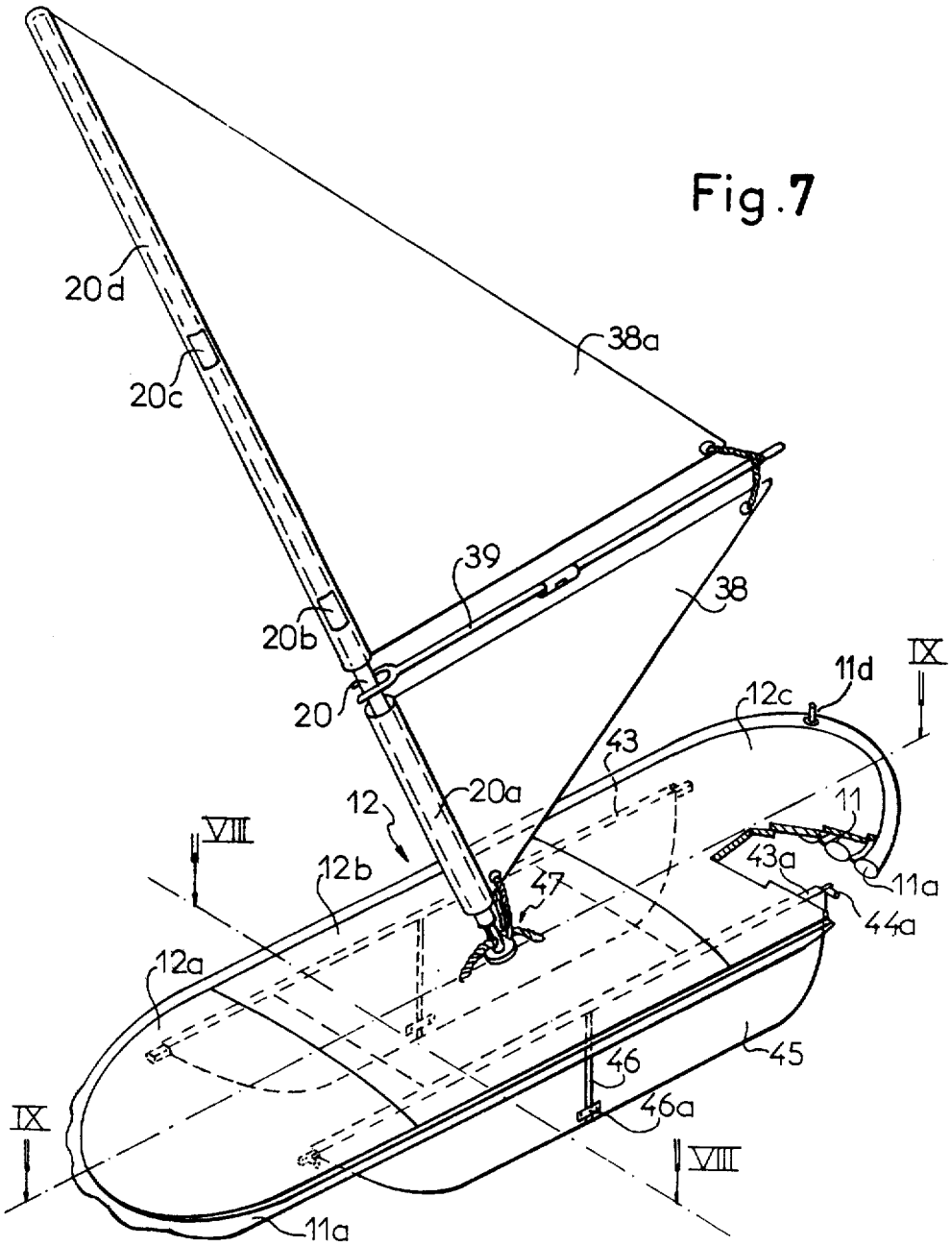
Figure 8:
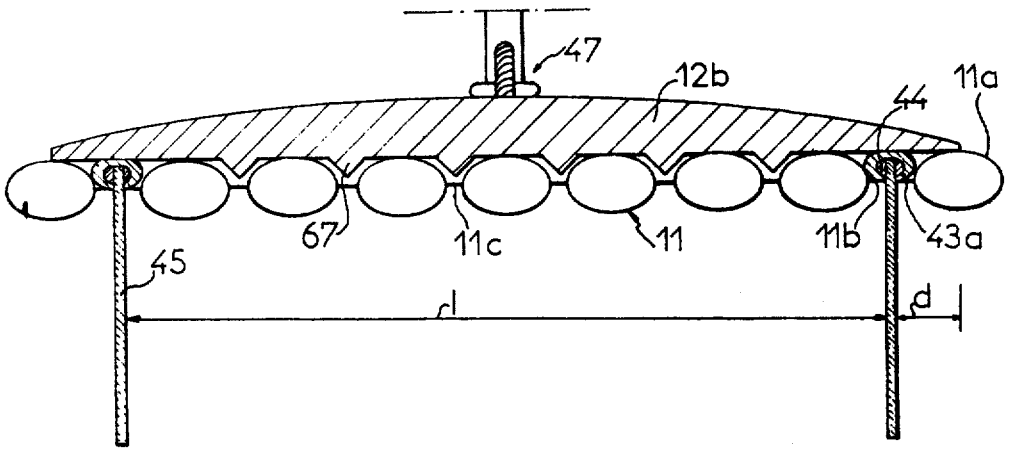
Figure 10:
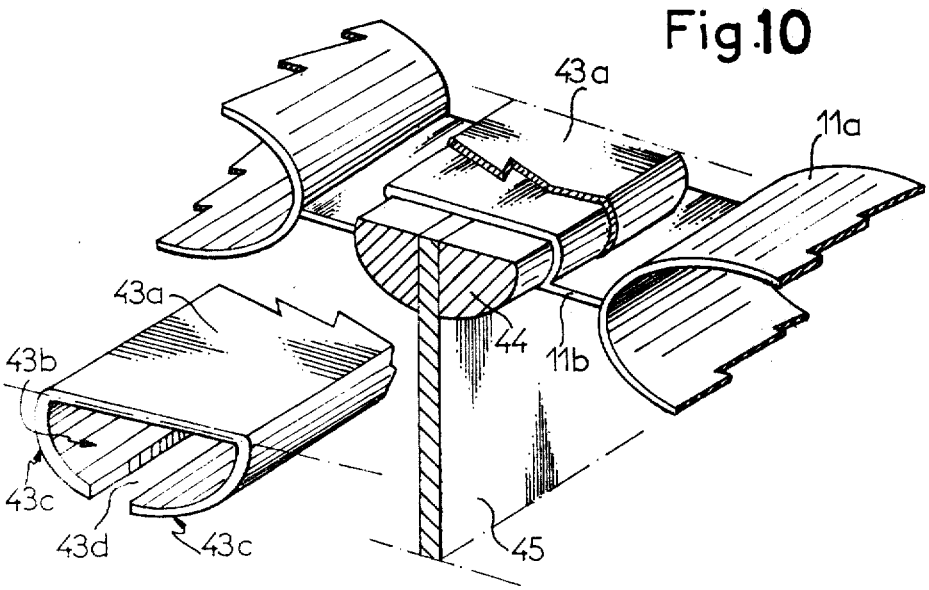
Figure 9:
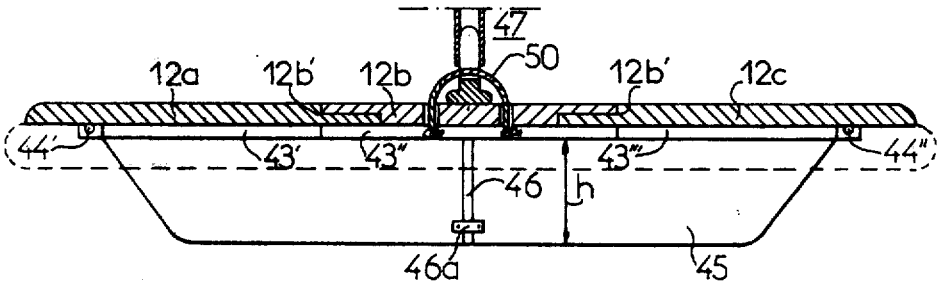
Figure 12:
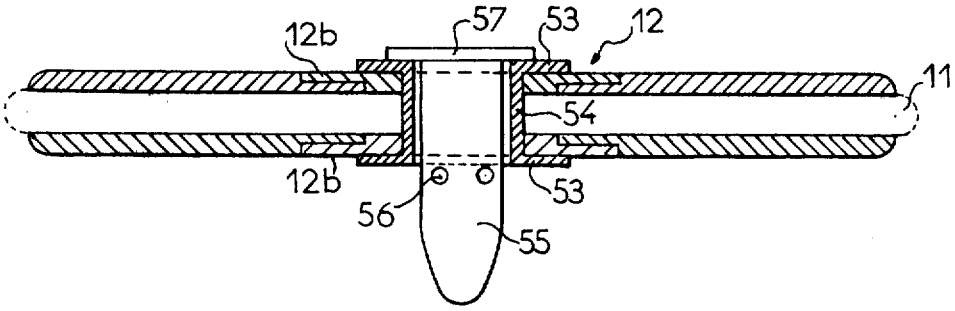
Figure 11:
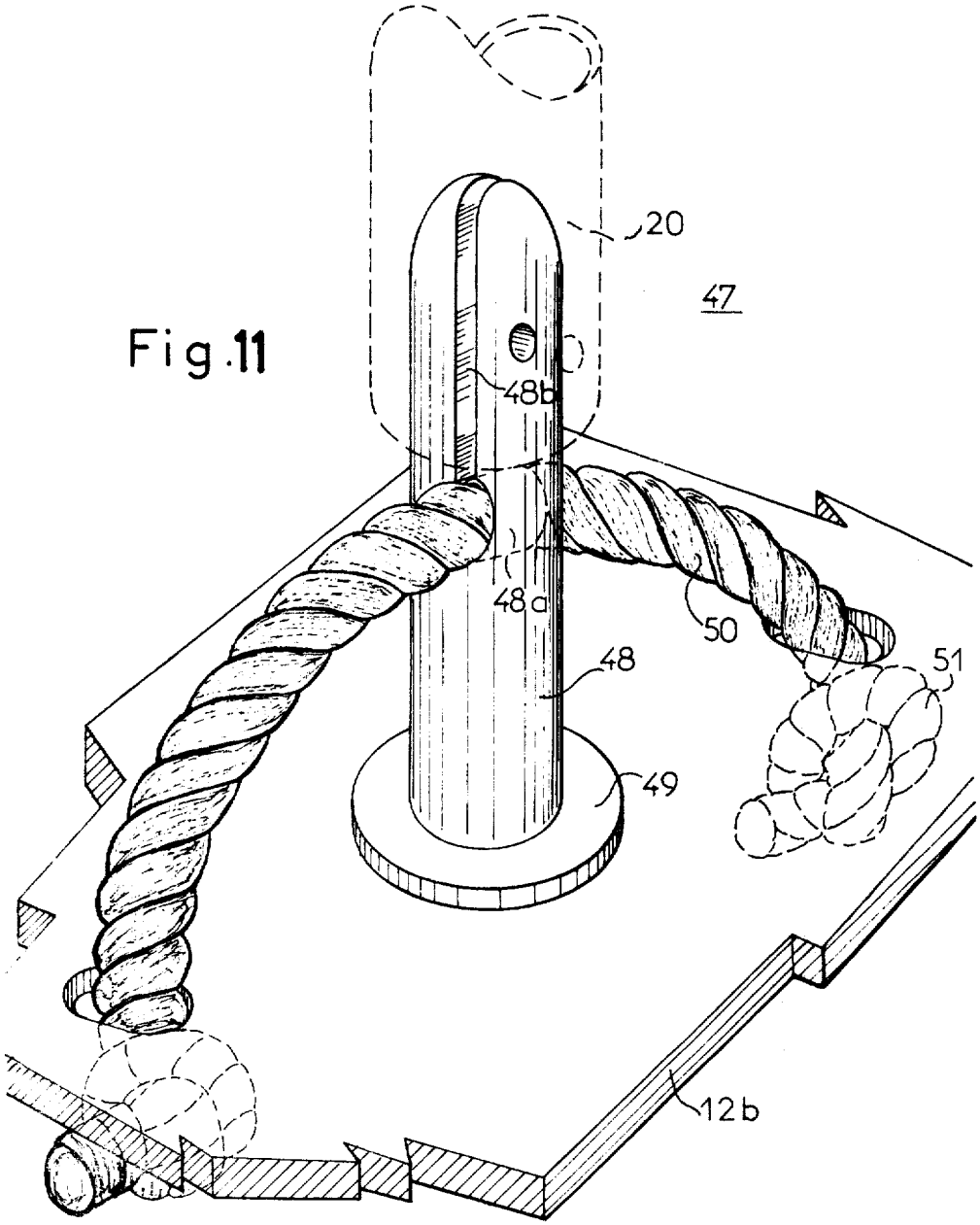

Other characteristics and advantages of the invention will be seen from the detailed description which follows of the improvements which the invention makes to a sail board and which are shown in the accompanying drawings wherein:

FIG. 1 is a perspective view, with a portion removed, of a boat according to a first embodiment of the invention, FIG. 1*a* is a partial cross-section along Ia—Ia of FIG. 1 showing in detail the assembly between two component semirigid elements of the hull of the boat, FIG. 2 is an exploded perspective view showing in detail an embodiment of the articulation of the foot of the mast at the region of the point at which it is planted upon one of the constituting components of the hull, FIG. 3 is a partial transverse cross-section of the boat along III—III of FIG. 1, FIG. 4 is a partial perspective view showing the connection between two rigidizing elements of the hull, FIG. 5 is a perspective cross-sectional view of another configuration of the boat and hull, FIG. 6 is a transverse cross-sectional view showing the arrangement of the component elements of the boat of FIG. 1 in a transport container, FIG. 7 is a perspective view with a portion cut away showing a preferred configuration of the floating device according to the invention, FIG. 8 is a transverse cross-sectional view of the device along VIII—VIII of FIG. 7, FIG. 9 is a longitudinal cross-sectional view of the device along IX—IX of FIG. 7, FIG. 10 is a perspective view showing interior details of a rigidifying and assembly element of the constituent components of the envelope of the inflatable bladder, FIG. 11 is a perspective view showing in detail the attachment arrangement for the foot of the mast, FIG. 12 is a longitudinal sectional view of the device showing another configuration of the envelope.

Referring to FIG. 1, the floating device according to the invention takes specifically the form of a sail board generally designated by reference numeral 10. The hull of this device consists of at least one inflatable partitioned bladder 11 which provides the floatation chamber of the device. In the example illustrated, two bladders are positioned on one side and the other of the vertical plane of symmetry of the hull.

In combination with the inflatable bladder or bladders, the hull also includes an envelope generally designated by reference numeral 12.

This envelope is formed by demountable components 12*a*, 12*b*, 12*c*, transversely subdivided and made of semirigid material, e.g. a heat molded sheet of polyvinyl chloride. The hull further includes, as constituent elements, rigidifying panels 13*a*, 13*b*, positioned between the one or more inflatable bladders 11 and the hull elements 12*a*, 12*b*, 12*c*. In combination with these hull elements and the one or more bladders, these form a structure which is layered at least in the horizontal plane and whose strength is provided by inflation of the one or more bladders.

Experience has shown that this layered structure is particularly effective to provide excellent longitudinal rigidity for the device. To the rigidifying elements, 13*a* and 13*b* positioned in a horizontal plane, there may advantageously be added a rigidifying element 14 positioned in a vertical plane, preferably in the longitudinal plane of symmetry of the device as shown in FIG. 1.

The envelope component 12*b*, or middle component has uniform cross-section. This component has on its top portion an attachment for the mast which will be described in detail later. This same middle component 12*b* has on its bottom face longitudinal ridges 15 adapted to receive by simple engagement a keel 16 of which a detailed configuration will be provided with reference to the description of FIG. 3.

Envelope component 12*b* receives by simple engagement two symmetrical end components 12*a*, 12*c* of progressively decreasing cross-section. End components 12*a*, 12*c* attach to middle component 12*b* by means of an engagement lip 12*d*. As shown in FIG. 1*a*, the engagement lip includes a shoulder 12*e* which limits the engagement when components 12*a*, 12*c* are assembled to middle component 12*b*. The engagement lip of 12*d* of each end component carries a plurality of protruding attachment studs 12*f* adapted to be inserted into corresponding apertures provided in the vicinity of the transverse edges of the middle component 12*b*.

It will be understood that, by virtue of this construction, under the influence of the inflation of the pneumatic bladders 11, there will take place a contacting reaction between the walls of the inflatable bladders, the rigidifying elements 13*a*, 13*b* and the envelope components 12*a*, 12*b*, 12*c* which assure that studs 12*f* remain seated.

According to one embodiment of the invention, it is advantageous to make the one or more bladders slightly longer than envelope 12 in order to promote upon inflation of the one or more bladders the locking and rigidity of the composite.

According to a preferred configuration, the rigidifying elements which may for example be planks of plywood are each formed of at least two sections 13*b*, 13*b*' which are in terms of force diagrams fixedly united by means of a hinge 17 as shown in FIG. 4. This hinge consists of a strip of flexible material such as a rubberized canvas, the strip having a marginal edge 18 attached to rigidifying element 13*b* and another marginal edge 19 attached to the other rigidifying element 13*b*'. The length of the flexible strip is substantially equal to the overlap distance of the two rigidifying elements. Thus, in use these two elements can no longer be displaced longitudinally relative to each other. On the other hand, this flexible connection allows pivoting of the hinge in such manner that these two elements can be completely superposed upon each other which enables their transporation within a small volume.

Referring again to FIGS. 1 and 2, it will be noted that the mast 20 of the device is attached at the stepping point positioned in the middle of the top surface of middle envelope component 12. This attachment is achieved by means of a saddle 21 formed of two brackets 22, 23 whose horizontal branches 23*a* are engaged in slots 24*a* provided in the middle envelope component 12. Slots 24*a* are oriented transversely to the longitudinal axis of the middle component. The vertical branches 22*b*, 23*b* of the brackets are connected by an axle 24 oriented along the longitudinal axis of middle component 12. Axle 24 is the first of two axles of a gimbal suspension. To that end, the first axle 24 is fixed to a bearing support 25 whose bearing recess 26 is oriented perpendicularly to the first axle 24. The bearing 26 is straddled by a fork 27 whose branches are connected to bearing support 25 by means of the second axle 28 of the gimbal suspension. Fork 27 of the gimbal suspension is extended by a pivot 29 provided at its base with a shoulder 30 whose purpose will be described later. Pivot 29 is provided in the vicinity of its free end with a protruding stud 31 which serves to immobilize longitudinally a ring 32 fixed to the foot 20*a* of the mast. Ring 32 can turn about pivot 29 and may become impaled upon the latter due to the presence of a groove 33 provided upon a generating surface of its interior opening.

At one angular position of stud 31 and groove 33, ring 32 is actually engaged upon pivot 29 and stud 31 comes out of groove 33, thereby permitting rotation of ring 32 around pivot 29. At an angular position other than the position of axial engagement, ring 32 is urged by its edge 34 against the edge 31*a* of stud 31. In the engaged condition, ring 32 bears upon the corresponding shoulder 30 of fork 27 through the intermediary of shoulder 35.

Shoulder 35 of ring 32 has a radial extension 36 which serves at attachment point to a line 37 for attachment of lower sail 38. It will be noted that mast 20 is composed of three sections joined together by sleeves 20*b*, 20*c*. The rigging includes two sails. The one designated 38*a* is a triangle extending from the tip of mast head 20*d* to boom 39. The other sail 38 extends from boom 39 to mast foot 20*a*.

According to one embodiment, boom 39 may include slidably mounted paddle blades 40, 41, produced for instance by heat molding and capable of being displaced to the ends of the boom which then can be utilized as emergency paddles.

In view of the possibility of deviation of the device in one direction or the other from the longitudinal axis, there is provided as previously indicated a keel 16 described hereafter with reference to FIG. 3. This keel takes the cross-sectional shape in the general form of a V and this keel is preferably made of flexible sheet capable of being flattened, e.g. a sheet of polyvinyl chloride. Its attachment is achieved by simple poking through slots 15*a* provided in ridges 15 positioned on one side and the other of the longitudinal axis of the middle component 12. A retainer bead 16*a* is provided along the free edges of the keel to ensure its being retained in its assembled state. However, the attachment of the retainer beads 16*a* of the keel within slots 15*a* and ridges 15 should be loose enough so that in case of accidental impact there takes place an unhooking which protects the hull and the user from violent impact.

According to another configuration of the device shown in FIG. 5, the inflatable bladder 11 is partially covered by the envelope components 12*a*, 12*b*, 12*c*, particularly from above and on the sides. The bottom of the bladder is in direct contact with the water. The middle cover component 12*b* extends into two components 12*b*' positioned in a vertical plane, these two components having a submerged portion forming a double keel. In this mode of realization, the end components 12*a*, 12*c* are joined to the middle component 12*b* by latched engagement as in the case of the illustrative embodiment of FIG. 1. However, it is advantageous that one of the studs 12*f* is positioned on the vertical cover portion of the said envelope components. This permits keeping these components well aligned without the danger of opening at the shoulder which forms an abutment at the joint of each engagement.

Regardless of the specific configuration used, the component elements of the device can be placed in a container of small volume 42 such as shown in FIG. 6. In this container there will be first the middle component 12*b* into which one has engaged the components 12*a* and 12*c*. There is room for the flattenable keel 16 in the end component 12*c* by dividing this component into two compartments. In one compartment is placed the inflatable bladders 11 and the mast foot attachment 21. In the other compartment there is placed on the one hand sails 38 and 38*a* as well as components of mast 20 and of boom 39. Vertical rigidifying element 14 finds its place between end components 12*a* and middle component 12*b*.

The horizontal reinforcement elements 13*a*, 13*b* find their place between middle component 12*b* and outer container wall 42. This makes it possible to achieve a container of very small volume easily transportable in a car trunk.

Each hull element can be made in unitary fashion and be provided in its horizontal junction region with a protruding edge 43. This edge can preferably be encircled by a cover strip 44 which contributes on the one hand to the strength of the elements in the assembled condition and on the other hand provides an antiabrasion belt.

In the form of construction shown in FIGS. 7 to 11, the hull of the device is made as in the first form of construction, of an inflatable bladder 11 constituting the floatation chamber of the device. A valve such as shown at 11*d* in FIG. 7 is provided for inflating the bladder 11. This bladder is positioned below envelope components 12*a*, 12*b*, 12*c* which, in this example, constitute the deck. In this form of construction the envelope components may be constituted by simple flat panels which may be cut from a simple sheet of plywood or made of plastic material, e.g. of a molded sheet of polyvinyl chloride, or by any other appropriate procedure using known molding techniques.

To keep the envelope components 12*a*, 12*b*, 12*c*, rigidly assembled, there are provided assembly and rigidifying elements designated generally by reference numeral 43*a*. These assembly elements are positioned in one or more rows along the longitudinal axis of the hull.

The assembly and rigidifying elements consist on the one hand, as appears from FIGS. 8 and 10, of a hollow beam 43*a* preferably of polygonal cross-section and, on the one hand, of at least one locking pin 44*a* of cross-section corresponding to that of the beam. In this manner pin 44*a* slidingly engages within channel 43*b* of the beam, as a result of which there is formed a firm connection between two adjoining beams particularly in the region of the transverse subdividing lines of the demountable components 12*a*, 12*b*, 12*c* of the envelope.

According to a preferred from of construction, the cross-section of the assembly beam 43*a* is inscribable in a triangle whose base is adjacent to envelope components 12*a*, 12*b*, 12*c*. It goes without saying that beam 43*a* may be a separate beam, attached by any appropriate means to the envelope components, but it may also be formed in the same molding process with the said envelope components. The side portions 43*c* of beam 43*a* are separated at the peak of the triangular cross-section by a slot 43*d* which provides access to the interior channel 43*b* of the beam.

Locking pins 44 which slidingly engage within beams 43 have, along one of their generating surfaces, a flat blade 45 designed to provide an additional perpendicular rigidifying plane perpendicular to the base 43*a* of the polygonal beam and therefore also perpendicular to the plane of envelope components 12*a*, 12*b*, 12*c*. In addition to providing rigidity against bending efforts exerted upon beam 43, blades 45 have a height sufficient so that they can act as keels.

According to a preferred construction, beams 43, pins 44 and blades 45 are positioned in two rows parallel to the longitudinal axis of the hull. These rows are placed at a distance d relative to the lateral edges of the envelope components 12a, 12b, 12c. This construction makes it possible, as appears from FIGS. 7 and 8, to surround the deck with at least one inflatable tubular element whose function is described in detail below.

A given rigidifying row of envelope components 12a, 12b, 12c, includes three sections of the polygonal beam designated in FIG. 9 by reference numerals 43', 43'', 43'''. In these three beams there are engaged two pins 44' and 44'' and two corresponding blades 45. The pins and the blades preferably meet in the region of longitudinal subdivision 46 positioned equidistantly between the subdividing lines 12b' of envelope component 12b. Thus the said subdivisions between the middle envelope elements and the end components 12a, 12c are connected by a continuous section of pins 44 and blade 45.

It will further be noted that there is provided a latching arrangement preventing separation of the envelope components 12a, 12b, 12c when assembled. To that end the ends of pin 44 include a stop projection 44a which bears upon the end section of beam 43' and 43''', whereas the blades 45 of the two pins 44 are joined in the region of subdivision 46 by an attachment 46a.

The inflatable bladder, as shown in FIGS. 7 and 8, consists of a series of tubular chambers parallel to the axis of the hull and covering the width 1 of the envelope components 12a, 12b, 12c defined between the parallel rows of assembly and rigidifying beams. In this form of construction it is desirable that the inflatable bladder extends beyond the contour of the envelope components in the form of a shock absorbing inflatable belt 11a. This shock absorbing belt is inflated by a valve which is independent of the inflating valve for the portion of the bladder positioned between blades 45. In this way there is obtained, on the one hand, an independent floatation chamber, and there is increased lateral stability for the hull and there is provided protection from swimmers who might bump into the craft.

In a preferred form of construction the shock absorbing belt 11a is joined to bladder 11 by a connecting sheet 11b positioned within sections of assembly and rigidifying beam 43. The size of sheet 11b is sufficient to enable two forms of attachment of the entire bladder below elements 12a, 12b, 12c of the hull.

According to a first form of construction, the sheet 11b is inserted through slot 43d of beams 43 and conforms to the internal contour of the beams. Pin 44 is inserted into the beam and holds sheet 11b against the inside wall of the beam, the sheet being thereby fixed and trapped within the beam.

According to another form of construction, there is provided a longitudinal slot in sheet 11b. This slot conforms to the length of blades 45 so that this slot can be engaged upon blades 45 up to the region of beam 43.

According to another form of construction, a supplemental floatation chamber forming the belt may further be associated with a sheet replacing the inflatable bladder previously described that sheet occupying the surface circumscribed by the belt which can therefore be utilized around a sail board such as shown in FIG. 1, or even with a conventional unitary board, in order to provide a shock absorbing belt and a supplemental floatation and stabilizing chamber. Regardless of the supplemental floatation arrangement which is used, it permits two people to occupy the same board, e.g. as teacher and beginner, thereby facilitating teaching the operation of the sail board.

Envelope components 12a, 12b, 12c preferably have on their contact face with the inflatable bladder stiffening ridges 67 paralleling the axis of the hull. These ridges extend between the tubular chambers of the bladder 11 in the area of the junction sheets 11c separating the tubular chambers.

Referring again to FIGS. 7, 8, 9 and 11, it will be noted that the mast 20 of the device is preferably attached at the center of the top surface of component 12b. Attachment of the mast is achieved in this form of construction by means of a mast foot attachment device generally designated by reference numeral 47. The attachment device consists of a pivot axle 48 whose base consists of a moveable foot 49 which rests freely upon the middle envelope component 12b. The pivot axle is attached to the middle component by a flexible link 50 in the form of an arch. The ends of the flexible link are attached to the middle component by passing through two apertures provided in component 12b and are held below that component by means of a knot 51 or by means of another holding device. Flexible link 50 is engaged in an opening 48a which passes radially through pivot axle 48. Access to opening 48a takes place through an axial slot 48b which opens at the free end of the axle. The tubular end of the foot of mast 20 slides over the slotted end of the pivot axle. It has proven advantageous to make the pivot axle of relatively elastic material such as a molded substance, synthetic rubber, plastic material, but it can also be made of rigid material such as metal. This attachment of the mast foot has proven to be particularly reliable and economical and its assembly by simple hooking is extremely fast.

There can also be provided another form of construction of the mast foot, the latter consisting as previously of a pivot axle whose base is constituted by a moveable foot. In this form of construction the pivot axle is made hollow so that one can introduce into it the two free ends of the flexible link 50. These ends are retained by a simple knot which abuts against the radial upper face of the pivot axle.

There can also be provided another form of construction in which the flexible strap is connected directly to the mast. In that case, the strap passes through an aperture which diametrically traverses the foot of the mast. Rotation of the mast is possible in that case within the torsion limit of the strap. Finally, it will be noted that strap 50 is inseparable from the mast, for example because of a line positioned between the lowest point of sail 38 and the strap as shown in FIG. 7. This line may also be attached, for example, between the lowest point of the sail and the mast foot support.

In the form of construction shown in FIG. 12, the craft hull includes both above and below the inflatable bladder 11, an envelope 12, respectively consisting of three components 12a, 12b, 12c, similar to those previously described. The facing middle components 12b are joined to each other by demountable support plates 53 which can slide relative to the walls of a keel box 54 and which can also be fixed relative to the walls of the keel slot so as to bear in compression upon middle components 12b which face each other and which, themselves, bear upon the inflatable bladder 11. In this form of construction the keel box extends in a vertical plane in the longitudinal axis of the hull. Inside the keel box there engages slidably a center board 55 through which can be engaged pegs 56 latching in position one of the bearing plates 53 the other plate being maintained stationary by a cover plate 57 fixed to keel 55.

I claim:

1. In a floating device, particularly a sail board, having a hull equipped with at least a keel, a mast attached to the hull, and a sail attached to the mast, the improvement which comprises the hull having at least one inflatable bladder forming a floatation chamber; and an envelope for the bladder, subdivided transversely to the longitudinal axis of the hull into a plurality of demountable, rigid or semi-rigid components, the envelope having three components, a middle component, and two end components, the envelope components partially covering the inflatable bladder, particularly the top of the bladder, the bottom being adapted for direct contact with the water, the said envelope components being transversely subdivided and maintained rigidly assembled by assembly and rigidifying elements positioned in one or more rows following the longitudinal axis of the hull, each assembly and rigidifying element being fixed to an envelope component in an arrangement capable of permitting alignment of the assembly elements in a single row, the said assembly and rigidifying elements comprising a hollow beam of preferably polygonal cross-section and at least one locking pin of cross-section corresponding to that of the beam, the pin engaging slidably within the internal channel of the beam and providing the connection between two adjacent beams, particularly at the point in the regions of the transverse subdividing lines of the demountable envelope components and of the beams.

2. The device of claim 1 wherein the cross-section of the assembly beam is preferably inscribable within a triangle having a base adjacent the envelope elements and having lateral sides separated in the region of the peak of the triangular section by a slot which provides access to the internal channel of the beam.

3. In a floating device, particularly a sail board having a hull equipped with at least a keel, a mast attached to the hull, and a sail attached to the mast, the improvement which comprises the hull having at least one inflatable bladder forming a plurality of tubular floatation chambers with connecting sheets between the chambers; and an envelope for the bladder, subdivided transversely to the longitudinal axis of the hull into a plurality of demountable, rigid or semi-rigid components, the envelope components having stiffening ridges on their contact face with the inflatable bladder, the ridges paralleling the axis of the hull and extending between the tubular chambers of the bladder, in the region of connecting sheets between chambers.

4. In a floating device, particularly a sail board, having a hull equipped with at least a keel, a mast attached to the hull, and a sail attached to the mast, the improvement in the hull which comprises at least one inflatable bladder forming a floatation chamber; and an envelope for the bladder, subdivided transversely to the longitudinal axis of the hull into a plurality of demountable, rigid or semi-rigid components, the envelope having three components, a middle component, and two end components, and the improvement in the mast comprising the mast being attached by an orientable arrangement at the foot of the mast, the arrangement taking the form of a pivot axle having a slotted end and having at its base a mobile foot resting freely upon the top of the middle envelope component, the pivot axle being attached to the middle component by a flexible strap in the shape of an arch whose extremities are attached to the middle component, the flexible strap being engaged in an opening which passes radially through the pivot axle, access to the opening being through the slotted end of the pivot axle, and the mast foot having a tubular end which engages and covers the slotted end of the pivot axle.

5. In a floating device, particularly a sail board, having a hull equipped with at least a keel, a mast attached to the hull, and a sail attached to the mast, the improvement which comprises the hull having at least one inflatable bladder forming a floatation chamber; and an envelope for the bladder, subdivided transversely to the longitudinal axis of the hull into a plurality of demountable, rigid or semi-rigid components, the envelope having three components, a middle component, and two end components, the three envelope components covering at least the top of the bladder and being transversely sectioned, the middle component having uniform cross-section and the two end components being symmetrical and having progressively decreasing cross-sections, the said end components being connected to the middle component by means of an engagement lip having a shoulder bearing protruding attachment studs adapted to be inserted into corresponding apertures provided near the transverse edges of the said middle component.

6. In a floating device, particularly a sail board, having a hull equipped with at least a keel, a mast attached to the hull, and a sail attached to the mast, the improvement in the hull which comprises at least one inflatable bladder forming a floatation chamber;

an envelope for the bladder, subdivided transversely to the longitudinal axis of the hull into a plurality of demountable, rigid or semi-rigid components, the envelope having three components, a middle component, and two end components; and the improvements in the hull and keel comprising rigidifying means associated with the demountable components to form in the assembled condition an envelope which is rigid at least lengthwise of the hull, the rigidifying means comprising at least two hollow beams extending longitudinally of the hull, two panels extending longitudinally of the beams, and pins slidable into the beams to secure the panels to their respective hollow beams, said panels being configured to provide a double keel for the device.

7. In a floating device, particularly a sail board, having a hull equipped with at least a keel, a mast attached to the hull, and a sail attached to the mast, the improvement which comprises the hull having at least one inflatable bladder forming a floatation chamber; and an envelope for the bladder, subdivided transversely to the longitudinal axis of the hull into a plurality of demountable, rigid or semi-rigid longitudinal components, said components having lateral edges, and said components including two end components and one middle component, the envelope components partially covering the inflatable bladder, particularly the top, the said envelope components being assembled and rigidified by two hollow slotted beams cooperating with locking pins, at least one of the locking pins for two consecutive sections of the beams extending along the interior of the beam into a blade having a thickness equal to or less than the slot of the beam in order to be able to slide through the slot and provide a rigidifying plane perpendicuar to the plane of the hull, the beams, the pins, and the blades being disposed in two rows paralleling the longitudinal axis of the hull, toward the interior from the lateral edges of said components of the envelope, a given row comprising three sections of the hollow beam, two pins and two corresponding blades, the pins and the blades meeting preferably in the region of said middle component midway between the lines of subdivision of the middle component so that said components between the middle component and one of the end components are connected by a continuous section of pin and blade.

8. In a floating device, particularly a sail board, having a hull equipped with at least a keel, a mast attached to the hull, and a sail attached to the mast, the improvement which comprises the hull having at least one inflatable bladder forming a floatation chamber; and an envelope for the bladder, subdivided transversely to the longitudinal axis of the hull into a plurality of demountable, rigid or semi-rigid components, the inflatable bladder comprising a plurality of tubular chambers paralleling the axis of the hull and sufficient in number to extend across the width of the envelope components, and the inflatable bladder extending beyond the contour of the envelope components and forming an inflatable shock absorbing and stabilizing belt.

9. In a floating device, particularly, a sail board, having a hull equipped with at least a keel, a mast attached to the hull, and a sail attached to the mast, the improvement which comprises the hull having at least one inflatable bladder forming a floatation chamber; and an envelope for the bladder, subdivided transversely to the longitudinal axis of the hull into a plurality of demountable, rigid or semi-rigid components, the envelope components partially covering the bladder, particularly its top, the envelope components being assembled and rigidified by hollow beams cooperating with locking pins and a shock absorbing belt connected to the bladder by a connection sheet placed in the region of the hollow beams.

10. In a floating device, particularly a sail board, having a hull equipped with at least a keel, a rigging attached to the hull, the rigging including at least a mast and a sail, the improvement which comprises the hull having at least one inflatable bladder forming a floatation chamber; and an envelope for the bladder, subdivided transversely to the longitudinal axis of the hull into a plurality of demountable, rigid or semi-rigid components, the envelope having three components, a middle component, and two end components, and further improvements in the hull and rigging, comprising the hull and rigging being adapted to be disassembled and having such dimensions that they are capable of being confined when disassembled within the region circumscribed by the middle component.

11. In a floating device, particularly a sail board, having a hull equipped with at least a keel, a mast attached to the hull, and a sail attached to the mast, the improvement in the hull which comprises at least one inflatable bladder forming a floatation chamber; and an envelope for the bladder, subdivided transversely to the longitudinal axis of the hull into a plurality of demountable, rigid or semi-rigid components, wherein the envelope has three components, a middle component, and two end components, wherein further improvements in the hull and keel comprise the inflatable bladder being partially covered by the envelope components particularly on the top and sides, the bottom of the bladder being exposed to direct contact with the water, the middle envelope component cooperating with two separate elements positioned in a vertical plane, the two elements having a portion adapted for immersion to provide a double keel.

* * * * *